US005823388A

United States Patent [19]

Green

[11] Patent Number: 5,823,388

[45] Date of Patent: Oct. 20, 1998

[54] LIQUID DISPENSER HAVING FLOW RATE COMPENSATION

[75] Inventor: Thomas S. Green, Atwater, Ohio

[73] Assignee: ABC TechCorp, Akron, Ohio

[21] Appl. No.: 746,816

[22] Filed: Nov. 18, 1996

[51] Int. Cl.[6] ..... B67D 5/08

[52] U.S. Cl. ..... 222/1; 222/59; 222/61; 222/318

[58] Field of Search ..... 222/1, 61, 63, 222/59, 71, 73, 318, 334, 373, 504, 642

[56] References Cited

U.S. PATENT DOCUMENTS 3,216,622 11/1965 Drostholm ..... 222/318
4,371,096 2/1983 Scholl et al. ..... 222/318
5,556,002 9/1996 Green ..... 222/61

*Primary Examiner*—Philippe Derakshani
*Attorney, Agent, or Firm*—Renner, Kenner, Greive, Bobak, Taylor & Weber

[57] ABSTRACT

A method and apparatus for dispensing a predetermined quantity of a liquid from a dispensing pump. A recirculation path from the dispensing pump to a bulk reservoir is configured to be substantially identical to the dispensing path itself. Periodically, a recirculation cycle is undertaken and the flow rate during the recirculation cycle is determined. With the recirculation and dispensing paths being identical, the dispensing rate for the dispensing path is then known. The method for accurately determining the recirculation rate is derived from Boyle's law to determine the specific volume dispensed in a specific recirculation cycle time.

16 Claims, 1 Drawing Sheet

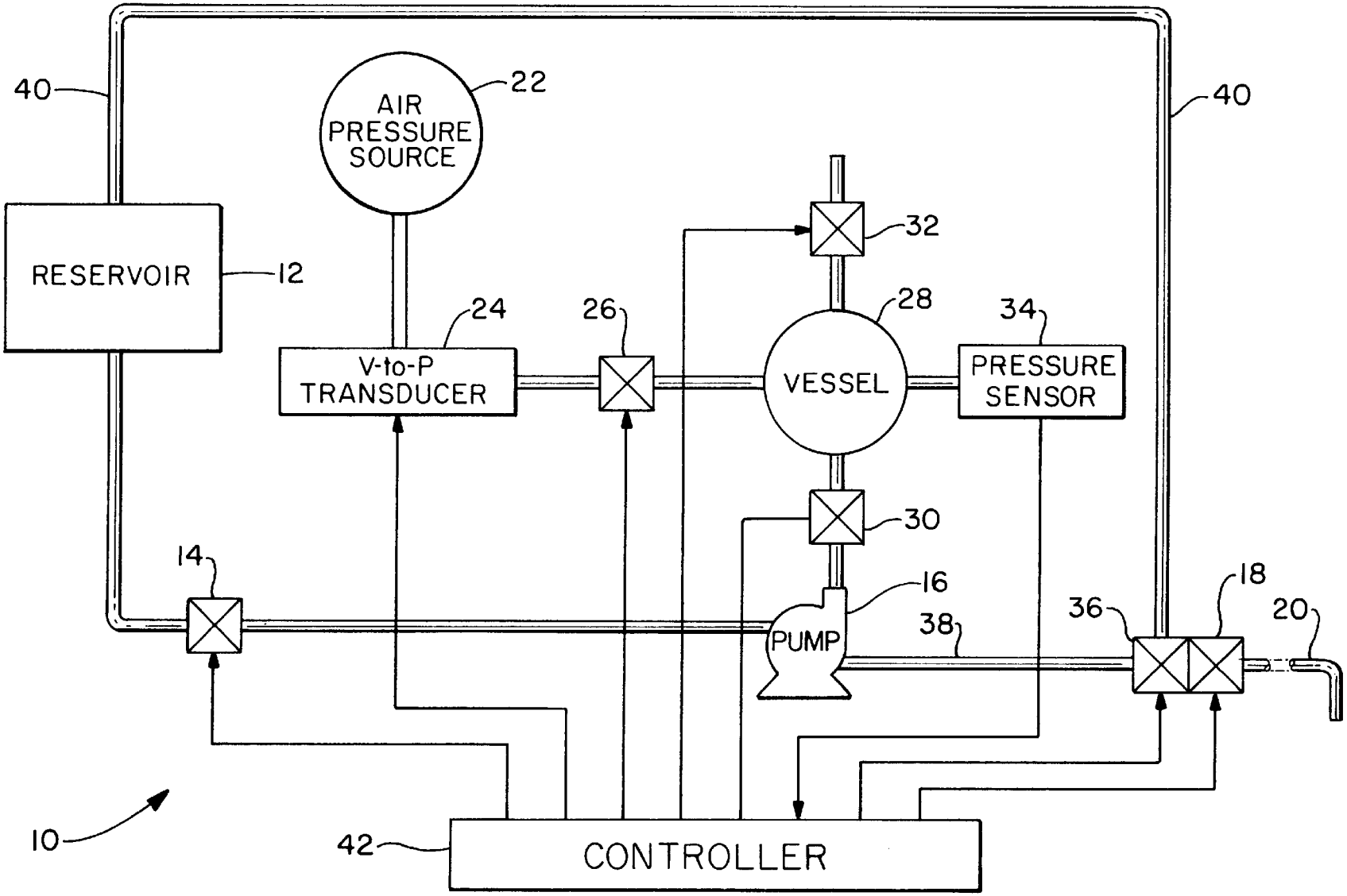
40
20
18
36
PRESSURE SENSOR
34
38
32
28
VESSEL
30
16
PUMP
CONTROLLER
26
22
AIR PRESSURE SOURCE
24
V-to-P TRANSDUCER
42
12
RESERVOIR
14
40
10

LIQUID DISPENSER HAVING FLOW RATE COMPENSATION

TECHNICAL FIELD

The invention herein resides in the art of liquid dispensing apparatus and, more particularly, to a liquid dispensing apparatus capable of accurately dispensing predetermined volumes of liquid. Specifically, the invention relates to a liquid dispenser in which changes in the liquid and/or system are periodically monitored and adjustments in dispensing time made in order that precise volumes of liquid may be dispensed upon request.

BACKGROUND ART

It is well known that in many liquid dispensing systems the accurate dispensing of components or ingredients is required for the resultant composition to be of acceptable quality. Such highly accurate and repeatable dispensing requirements pertain to such dispensing systems as beverage dispensers, paint dispensers, medical dispensers, and the like.

It is particularly well known that dispensing system structures change with time, as well as with changes in the ambient. Additionally, the liquids themselves often change with age, temperature variations, and the like. As a consequence, a liquid dispensing system cannot simply set a dispensing cycle for a particular duration and assume that the same quantity of liquid will be dispensed in that dispensing cycle over any course of time. As a system changes so do its performance characteristics. Likewise, time and temperature based changes in viscosity of liquids is well known. Accordingly, compensation must necessarily be made for such changes in order to insure that the dispensing cycle results in the dispensing of an anticipated amount of liquid.

It has been known to determine the flow rate of various liquids by correlating the viscosity of the liquid with its temperature and to thereafter either adjust the dispensing time or the dispensing pressure in order to achieve the dispensing of a desired quantity in a specific cycle of time. Typically, "look-up" tables are developed for such purpose. It has also been known to monitor recycle rates within a system to determine changes in the viscosity or flow characteristics of the liquid for anticipation of the flow rate during a dispensing cycle. However, it has been found that there are numerous inconsistencies and errors which enter into the determining of actual flow rates from recycle flow rates. Moreover, it has been found that each liquid, such as flavoring syrup, colorant, or the like has parameters which vary with respect to the manufacturer. age of the liquid, and the like. Additionally, many manufacturers make periodic reformulations of their products such that data obtained at one point in time may not be applicable at a later time. Moreover, it is extremely costly to develop the data necessary for effective look-up tables and then to constantly update the tables for formula changes and the like. Additionally, it has been found the there is a need to tailor each dispensing system to particular customers and their products. Further, where recycle rates were used to determine the likely dispensing flow rate within a system, the fact that the recycle path and the dispensing path were different often resulted in the dispensing flow rate being different from the recycle flow rate simply because of anomalies in the system itself.

It also is known that the actual flow rates of some liquids, such as paint colorants, are altered by the flow itself. In other words, the liquid "shears" or "thins" by the dynamics of the dispensing cycle such that the flow rate of the liquid is a function of the length of the dispensing cycle and/or the time period between dispensing cycles.

It has also been found that in many liquid dispensing systems, there is a need for apparatus and methodology for periodically agitating or "mixing" the liquid to prevent separation of liquids comprised of constituent ingredients. While various structures have been proposed in the past for such mixing or agitating, the same have generally been of a complex and ineffective nature.

Accordingly, there remains a need in the art for a liquid dispensing system which is capable of periodically and accurately determining flow rates and to adjust dispensing cycles or times accordingly. Moreover, there is a need for such a liquid dispensing system which provides for a simplistic and efficient apparatus and technique for periodically mixing or agitating the liquid.

DISCLOSURE OF INVENTION

In light of the foregoing, a first aspect of the invention is the provision of a liquid dispenser having flow rate compensation in which a dispensing path and a recirculation path are substantially identical such that a flow rate determined from the recirculation path inherently establishes the flow rate which would expected from the dispensing path.

Another aspect of the invention is the provision of a liquid dispenser having flow rate compensation in which Boyle's law may be employed to accurately determine flow rates and expected flow rates.

Another aspect of the invention is the provision of a liquid dispenser having flow rate compensation which provides for the establishment of flow rates at various pressures, with the accuracy of such determination being independent of system age or liquid characteristics.

A further aspect of the invention is the provision of a liquid dispenser that compensates for the dynamics of a dispensing cycle—particularly for those liquids whose viscosity changes as a function of flow.

Another aspect of the invention is the provision of a liquid dispenser having flow rate compensation and which also includes a simplistic structure and technique for periodically agitating or mixing the liquid.

Yet another aspect of the invention is the provision of a liquid dispenser having flow rate compensation which is reliable and highly accurate in use, simplistic in construction, and constructed using state of the art apparatus and techniques.

The foregoing and other aspects of the invention which will become apparent as the detailed description proceeds are achieved by a method of dispensing a predetermined quantity of a liquid from a pump, comprising: recirculating the liquid from the pump to a reservoir through a first flow path for a set period of time; determining the volume of liquid recirculated by the pump in said set period of time; determining a flow rate of the liquid through said first flow path; and dispensing the liquid from the pump through a second flow path, substantially identical to said first flow path, for a period of time sufficient to dispense the predetermined quantity of fluid at said flow rate.

Other aspects of the invention which will become apparent herein are achieved by a liquid dispensing apparatus, comprising: a source of regulated air pressure; a pump; a vessel of known fixed volume interposed between said source of air pressure and said pump; a reservoir of liquid in selective interconnection with said pump; a dispensing line connected to said pump; and a recirculation line selectively interconnecting said pump and said reservoir.

BRIEF DESCRIPTION OF THE DRAWINGS

For a complete understanding of the objects, techniques, and structure of the invention, reference should be made to the following detailed description and accompanying drawing wherein there is shown a schematic block diagram of a preferred embodiment of the invention.

BEST MODE FOR CARRYING OUT THE INVENTION

Referring now to the drawing, it can be seen that a fluid dispensing system according to the invention is designated generally by the numeral 10. The system 10 includes a reservoir 12 for receiving and maintaining a fluid to be dispensed. The fluid within the reservoir 12 may be of any of various natures, such as paint tint or colorant, beverage syrups, juice concentrates, disinfectants, and the like. A conduit interconnects the reservoir 12 with a pump 16, there being a control valve 14 interposed therebetween. In the preferred embodiment of the invention, the control valve 14 is a solenoid-actuated valve which is normally open. The pump 16 is a pressure pump, in which a head of air pressure is developed within the pump chamber for driving liquid therein through a conduit 38, and out of a dispensing line 20 when a solenoid-actuated dispensing valve 18 is opened.

A regulated air pressure source 22 is provided for supplying the pump 16 with the necessary pressure head to drive liquid therefrom. A voltage to pressure transducer 24 is connected to the pressure source 22 such that output pressure from the transducer 24 may be controlled by the application of an appropriate control voltage thereto. The air pressure from the source 22 which is regulated and set by the transducer 24 passes through a valve 26 to an appropriate vessel 28. The vessel 28 has a chamber of known fixed volume. A three way valve 30 is interposed within a conduit interconnecting the vessel 28 with the pump 16. An exhaust valve 32 is also connected to the vessel 28, as shown. A pressure sensor 34 communicates with the chamber of the vessel 28 to monitor the air pressure therein.

As shown, the conduit 38 from the pump 16 passes not only to a dispensing valve 18, but to an identical recirculation valve 36. The recirculation valve 36 is interposed between the conduit 38 and a recirculation line 40 which passes back to the reservoir 12. In the preferred embodiment of the invention, not only is the valve 36 identical to the valve 18, but the recirculation line 40 is identical to the dispensing line 20. In other words, the lines 20, 40 are of the same material, inside diameter, length, elevation, and the like. Accordingly, the recirculation path from the conduit 38, through the valve 36 and through the recirculation line 40 is substantially identical to the dispensing path through the conduit 38, dispensing valve 18, and dispensing line 20. In this regard, it will be appreciated at the drawings in diagrammatical and illustrative only.

As shown, a controller 42, such as a programmable dedicated microprocessor, is provided in interconnection with the voltage to pressure transducer 24, valve 26, exhaust valve 32, three-way valve 30, pressure sensor 34, dispensing and recirculating valves 18, 36, and the control valve 14. It will be appreciated that the control valve 14 is normally open such that liquid from the bulk reservoir 24 may freely replenish the pump 16.

In a normal dispensing operation, the control valve 14 is closed and air pressure at a level determined by the controller 42 through the voltage pressure transducer 24 is applied through the valve 26, into the vessel 28, through the three-way valve 30, and into the pump 16. Of course, the exhaust valve 32 is closed at this time. With the pump 16 so pressurized, the dispensing valve 18 is actuated for a predetermined period of time, such period being sufficient to allow for the dispensing of a predetermined volume of liquid from the pump 16. At the end of that dispensing cycle, the valve 18 is closed, the valves 30, 32 are exhausted, the valve 26 is closed, and the valve 14 is opened to allow the reservoir 12 to replenish the pump 16.

It will be appreciated that the dispensing from the pump 16 may occur at different pressure levels. For example, some dispensing systems are known to have a high pressure level for high volume dispensing, with lower pressure levels being employed for the dispensing of smaller quantities. Accordingly, it is desirable that the system 10 periodically determine the flow rate of the associated liquid at the various dispensing pressures. To this end, a recirculation cycle is engaged periodically, such as once an hour, with the recirculation taking place at one of the selected dispensing pressures. The next hour, recirculation may take place at another of the system's dispensing pressures and such recycling will sequentially continue on a periodic basis through each of the dispensing pressures. The recycle path of the conduit 38, recycle valve 36, and recirculation line 40 is employed for establishing the flow rate. As presented above, this recirculation path is, for all intents and purposes, identical to the dispensing path of the conduit 38, dispensing valve 18, and the dispensing line 20.

When recycling, the controller 42 closes the valves 14, 30 and 32. A voltage is applied to the transducer 24 to establish a selected air pressure level. The valve 26 is opened to allow that air pressure to fill the vessel 28. The pressure sensor 34 allows the controller 42 to determine that, in indeed, the requested pressure has been achieved. If not, appropriate adjustments can be made by increasing or decreasing the voltage to transducer 24. When the vessel 28 is at the desired pressure, the valve 26 is closed and the three-way valve 30 is opened to allow the vessel 28 to communicate with the pump 16. The drop in pressure of the combined volume of the chamber of the vessel 28 and pump 16 is sensed by the pressure sensor 34. According to Boyle's law, $P_1 V_1 = P_2 V_2$. With $V_1$ being the volume of the vessel 28, and with the pressure sensor 34 providing the pressure $P_1$ to the vessel 20 before the valve 30 was opened and the pressure $P_2$ after is was opened, the total volume $V_2$ of the combined volume of the vessel 28 and the head of the pump 16 can readily be determined. With this determination known, the three-way valve 30 and the exhaust valve 32 are opened to exhaust both the pump 16 and the vessel 28.

With the beginning head volume of the pump 16 being known, a recirculation cycle may be undertaken. With the valve 14 still closed, the pressure transducer 24 is energized to one of the characteristics dispensing levels of the system 10. With the valve 32 closed and the valves 26, 30 opened confirmation of the pressure is made by means of the pressure sensor 34. With the desired pressure thus being present and maintained, the recirculation valve 36 is opened for a set period of time which is a period of time sufficient to dispense a selected volume from the pump 16 back to the reservoir 12. At the end of that period of time, the valve 36 is closed. The pump 16 and vessel 28 are exhausted by the valves 30, 32 and the valve 26 is again closed,. It now needs to be determined exactly how much liquid was dispensed from the pump 16 during the fixed duration of time. Knowing that, the dispensing rate of the fluid at that point in time can be readily determined. Accordingly, the process of application of Boyle's law discussed above is undertaken again. The transducer 24 is adjusted to a desired pressure level, and the valves 30, 32 are closed. The valve 26 is opened to allow the vessel 28 to fill to the desired pressure level as determined by the pressure sensor 34. When that pressure is reached and confirmed, the valve 26 is closed and the valve 30 is opened, allowing the pressure in the vessel 28 to dissipate into the pump 16.

Again, applying the concept that $P_1 V_1 = P_2 V_2$, be determined by the same process set forth earlier herein. Obviously, the new head space will be greater than the previously determined head space since liquid has been dispensed from the pump 16. In fact, the difference in head space will equal the amount of fluid dispensed during the recirculation cycle of fixed time duration. Since the volume dispensed during recirculation is now known and the time of the recirculation cycle is known, the rate of dispensing during recirculation at that point in time can be readily determined. That rate of dispensing can then be employed by the controller 42 to establish the time duration necessary to achieve a specific volume of dispensed liquid on the next dispensing cycle. Since the dispensing path and the recirculation path are substantially identical, the dispensing rate for both paths will also be substantially identical and adjustments of dispensing time and/or pressure can thus be made for any changes in the system and/or the liquid due to time or ambient conditions.

As mentioned above, the recirculation will be undertaken at the various pressures at which dispensing is undertaken by the system 10. Accordingly, dispensing rates for each of these dispensing pressures can be determined and employed on the subsequent dispensing cycles.

It is further known that the flow rates of certain liquids actually change during a dispensing cycle. For some liquids the flow of the dispensing liquid shears the liquid and effectively changes its viscosity, or "thins" it. For other liquids, the flow rate may increase shortly after initiating the dispensing cycle, and subsequently decrease thereafter. Such characteristics are common with liquids such as paint colorants and must be taken into account to assure accurate dispensing. A determination of these flow rate characteristics may be attained by employing the recirculation technique described above and appropriate compensation may then be made during a subsequent dispensing cycle.

A recirculation cycle of the type described above can be undertaken for a fixed period of time $T_1$ and the average flow rate during time $T_1$ may be determined. The time period $T_1$ is generally much longer than a typical dispensing cycle. This is so that the effect of instrument errors is minimized. However, it is necessary to determine the flow rate of the liquid at volume levels which will typically be dispensed. Accordingly, a sequence of recirculation cycles, each being of a duration which is a known fraction of the time $T_1$, may be engaged until the aggregate of the incremental recirculation cycles is $T_1$. At that time, the total volume of liquid recirculated in the sequence of short recirculation cycles totalling time $T_1$ may be compared against the volume recirculated in the single cycle of time $T_1$ and the deviation, if any, may be determined.

That deviation, as a percentage, may be employed to adjust the determined average flow rate to equal an anticipated actual flow rate. This percentage adjustment may be made for dispensing cycles of a duration anywhere between that of the incremental recirculation cycle and the period $T_1$. Dispensing times would then be determined to achieve the dispensing of a desired volume.

By way of example, employing the foregoing methodology, assume that a seven second recirculation cycle were employed to determine an average flow rate. $T_1$ would equal 7 seconds. If the total volume recirculated in that time period was 10.5 ounces, the flow rate would be 1.5 ounces per second. If the actual flow rate at a 0.25 second dispensing cycle were desired, 28 incremental recirculation cycles of 0.25 seconds each would be exercised to equal a total recirculation period of 7 seconds ($T_1$). The volume recirculated in that 28 cycle period could then be readily determined employing Boyle's law, as above. If the total volume recirculated was determined to be 11.55 ounces, it would be clear that 10% more volume was dispensed in the 0.25 second incremental cycles than in the single 7 second cycle. The flow rate determined from the single recirculation cycle would need to be adjusted accordingly for use in determining dispensing cycle duration. In this case, the actual flow rate would be determined at 1.65 ounces per second.

It will, of course, be appreciated that data may also be obtained for flow rates at different incremental cycle periods and pressures such that the anticipated flow rate for specific dispensing cycles can be accurately determined.

It is also contemplated as a portion of the instant invention that the recirculation may be employed to agitate or "mix" the liquid by causing it to pass from the pump 16, through the dispensing line 40, and into the reservoir 12. Another means for achieving such mixing or agitation is also contemplated. In this embodiment, the pump 16 is energized and, with the valves 18, 36 closed, the valve 14 is opened to allow the liquid in the pump 16 to back flush into the reservoir 12, achieving the desired mixing or agitation. With pump 16 passing the liquid into the base of the reservoir 12, such agitation is assured.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby.

Accordingly, for an appreciation of the true scope and breadth of the invention reference should be made to the following claims.

What is claimed is:

1. A method of dispensing a predetermined quantity of a liquid from a pump, comprising:

recirculating the liquid from the pump to a reservoir through a first flow path for a set period of time;

determining the volume of liquid recirculated by the pump in said set period of time;

determining a flow rate of the liquid through said first flow path; and dispensing the liquid from the pump through a second flow path, substantially identical to said first flow path, for a period of time sufficient to dispense the predetermined quantity of fluid at said flow rate.

2. The method according to claim 1, wherein said recirculating of the liquid to said reservoir is undertaken on a periodic basis.

3. The method according to claim 2, wherein the pump is a pressure pump and said recirculating of the liquid to said reservoir is periodically undertaken at different pump pressures.

4. The method according to claim 1, wherein said step of determining the volume of liquid recirculated by the pump comprises releasing a known volume of air at a known pressure into said pump before the recirculating step and releasing a known volume of air at a known pressure into said pump after the recirculating step.

5. The method according to claim 4, further comprising the step of measuring pressure heads in said pump following said releasing of a known volume of air at a known pressure into said pump before and after the recirculating step.

6. The method according to claim 1, further comprising a step of periodically opening a conduit between the pump and the reservoir at a time that both said first and second flow paths are closed, causing a back flush of liquid from the pump to the reservoir to mix the liquid in the pump and reservoir.

7. The method according to claim 1, wherein said set period of time is divided into a plurality of incremental time periods.

8. The method according to claim 7, wherein said incremental time periods are of equal duration.

9. The method according to claim 7, wherein said pump is a pressure pump and said recirculating of the liquid to said reservoir is periodically undertaken at different pressures.

10. A liquid dispensing apparatus, comprising:

a source of regulated air pressure;

a pump;

a vessel of known fixed volume interposed between said source of air pressure and said pump;

a reservoir of liquid in selective interconnection with said pump;

a dispensing line connected to said pump; and a recirculation line selectively interconnecting said pump and said reservoir.

11. The liquid dispensing apparatus according to claim 10, further comprising a pressure sensor interconnected with said vessel.

12. The liquid dispensing apparatus according to claim 11 further comprising a first valve interposed between said source of regulated air pressure and said pump and a second valve interposed between said vessel and said pump.

13. The liquid dispensing apparatus according to claim 12, further comprising an exhaust valve connected to said vessel.

14. The liquid dispensing apparatus according to claim 13, further comprising a third valve received within said recirculation line.

15. The liquid dispensing apparatus according to claim 10, wherein said dispensing line and recirculation line have substantially the same flow characteristics.

16. The liquid dispensing apparatus according to claim 15, further comprising a dispensing valve in said dispensing line and a recirculation valve in said recirculation line.

* * * * *